US006051536A

United States Patent [19]

Igarashi et al.

[11] Patent Number: 6,051,536

[45] **Date of Patent: *Apr. 18, 2000**

[54] OIL COMPOSITION FOR CONTINUOUSLY VARIABLE TRANSMISSIONS

[75] Inventors: Hideo Igarashi; Junichi Deshimaru, both of Ichihara, Japan

[73] Assignee: Idemitsu Kosan Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/822,716

[22] Filed: Mar. 24, 1997

[30] Foreign Application Priority Data

Mar. 28, 1996 [JP] Japan ..... 8-074288

[51] Int. Cl.[7] ..... C10M 141/12; C10M 135/18; C10M 137/10

[52] U.S. Cl. ..... 508/364; 508/365; 508/379

[58] Field of Search ..... 508/363, 364, 508/365, 379

[56] References Cited

U.S. PATENT DOCUMENTS

| | | | |
|---|---|---|---|
| 3,772,197 | 11/1973 | Milsom | 508/364 |
| 4,178,258 | 12/1979 | Papay et al. | 508/364 |
| 4,529,526 | 7/1985 | Inoue et al. | 508/365 |
| 4,786,423 | 11/1988 | Schroeder | 508/363 |
| 4,846,983 | 7/1989 | Ward, Jr. | 508/363 |
| 5,356,547 | 10/1994 | Arai et al. . | |
| 5,364,545 | 11/1994 | Arai et al. . | |

FOREIGN PATENT DOCUMENTS

| | | |
|---|---|---|
| 0 609 623 | 8/1994 | European Pat. Off. . |

*Primary Examiner*—Jacqueline V. Howard
*Attorney, Agent, or Firm*—Oblon, Spivak, McClelland, Maier & Neustadt, P.C.

[57] ABSTRACT

An oil composition for continuously variable transmissions (CVT) comprising a base oil, (A) a sulfonate, (B) an ashless dispersant, (C) an acid amide, (D) an organomolybdenum compound, and (E) an amine antioxidant.

The oil composition for CVT prevents the scratching phenomenon while the transmitted power is kept large in CVT of a belt type used for automatic transmissions of automobiles. The gradient in the $\mu$-V characteristic can be kept positive for a long time.

20 Claims, 1 Drawing Sheet

OIL COMPOSITION FOR CONTINUOUSLY VARIABLE TRANSMISSIONS

FIELD OF THE INVENTION

The present invention relates to an oil composition for continuously variable transmissions (hereinafter referred to as CVT). More particularly, the present invention relates to a lubricating oil composition for CVT which can prevent the scratching phenomenon in CVT of a belt-type used for automatic transmissions in automobiles.

PRIOR ART OF THE INVENTION

CVT of a belt type used for automatic transmissions in automobiles consists of driving pulleys and a belt for transmission of the driving force. The belt consists of elements (referred to as tops) and a belt (a steel belt) holding the elements. Lubricating oil used for CVT of a belt type is generally required to have the cooling property and the lubricating property. The lubricating oil has also to provide the friction force of a specific magnitude or more to prevent slipping between the pulleys and the tops so that sufficient transmission of the driving force can be achieved.

In recent years, in some types of automobiles equipped with CVT of a belt type such as that described above, characteristic noise is generated when, for example, the automobiles are driven for parking or for starting. This is generally called a scratching phenomenon. The scratching phenomenon cannot be prevented by using a conventional lubricating oil which has the above characteristics alone, and development of a lubricating oil having superior characteristics has been required.

The present inventors extensively studied the above phenomenon and discovered that the scratching phenomenon is caused by the sound generated by teeth of gears disposed after CVT, and this is in turn caused by uneven rotation of the pulley driven by CVT. The present inventors also discovered that the uneven rotation takes place when the relation of the friction coefficient ($\mu$) between the belt and the top to the slipping speed (V) shows a negative gradient. Therefore, for preventing the scratching phenomenon, a lubricating oil showing a positive gradient in the above $\mu$-V characteristic must be developed.

However, when the friction coefficient is decreased in order to develop such a lubricant, a problem arises in that the ability to transmit the driving force is decreased. Therefore, the friction coefficient must be kept to a value which can surely transmit a driving force of the required magnitude or larger. Moreover, not only the fresh lubricating oil but also a lubricating oil after being used for a specified time must exhibit the above required properties. In other words, the above properties must be kept for a long time.

As described above, a lubricating oil for CVT of a belt type which can keep the friction coefficient to a value which can surely transmit a driving force of the required magnitude or larger and, at the same time, can prevent the scratching phenomenon has been required.

SUMMARY OF THE INVENTION

Accordingly, the present invention has the object of providing an oil composition for CVT which can prevent the scratching phenomenon while the power transmitted by CVT of a belt type used for automatic transmissions of automobiles is kept large and can also keep a positive gradient in the $\mu$-V characteristic for a long time.

The present invention was made under the above circumstances. As the result of extensive studies by the present inventors to achieve the above object, it was discovered that the scratching phenomenon in CVT of a belt type can be prevented and the transmission of a driving force of the required magnitude or larger is achieved when a lubricating oil for CVT which can keep a friction coefficient of a specific value or more and a positive gradient in the $\mu$-V characteristic is provided.

As the result of still more extensive studies by the present inventors, it was discovered that a sufficient driving force can be transmitted when $\mu$ has a value of 0.1 or more, that it is necessary for obtaining the above $\mu$-V characteristic that the value of $\mu$ is decreased with decrease in the value of V, in other words, the ratio ($\mu_s/\mu_d$) of a friction coefficient $\mu_s$ to a friction coefficient $\mu_d$ is smaller than 1, wherein $\mu_s$ represents a friction coefficient immediately before the slipping speed is reduced to zero, and $\mu_d$ represents a friction coefficient at a slipping speed of V, and that the scratching phenomenon does not take place when the above conditions can be kept for a long time. Conventionally used oil compositions for CVT do not satisfy the above requirements of the present invention. The oil composition for CVT of the present invention has been prepared on the basis of the above discovery.

Accordingly, the present invention provides an oil composition for CVT comprising a base oil, (A) a sulfonate, (B) an ashless dispersant, (C) an acid amide, (D) an organomolybdenum compound, and (E) an amine antioxidant.

Figure 1:
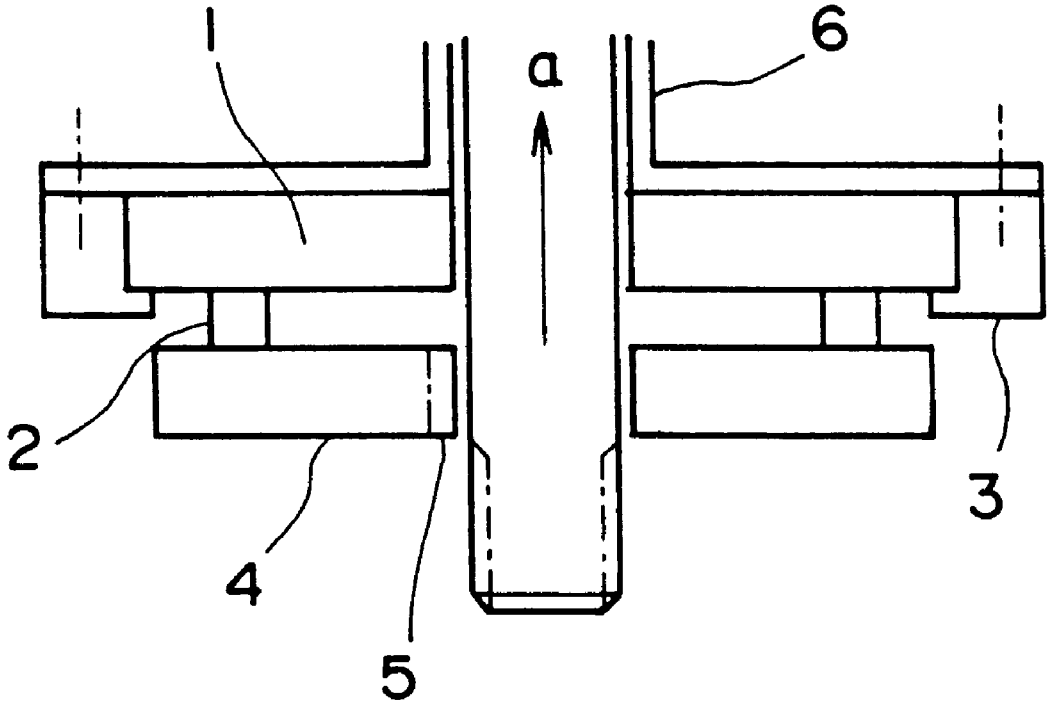
FIG. 1 shows a schematic sectional view exhibiting the friction mechanism of the rotating friction tester which gives the friction coefficient between two surfaces and is used for the measurement of the value of $\mu$ and the $\mu$-V characteristic in the present invention.

The numbers and the character in the figure have the meanings as listed in the following:

1: a disk

2: a pin

3: a holder for a disk

4: a holder for a pin

5: a key way

6: a rotating shaft a: a load

DETAILED DESCRIPTION OF THE INVENTION

The present invention is described in more detail in the following.

The oil composition for CVT of the present invention comprises a base oil, (A) a sulfonate, (B) an ashless dispersant, (C) an acid amide, (D) an organomolybdenum compound, and (E) an amine antioxidant.

As the base oil comprised in the oil composition for CVT of the present invention, a mineral oil or a synthetic oil can be used, and the type of the oil is not particularly limited. As the mineral oil, various types of conventionally used mineral oil can be used, Examples of the mineral oil include paraffinic mineral oils, intermediate mineral oils, and naphthenic mineral oils. As the synthetic oil, various types of conventionally used synthetic oil can be used. Examples of the synthetic oil include a-olefin oligomers, (co)polymers of olefins having 2 to 16 carbon atoms, alkylbenzenes, alkylnaphthalenes, polyphenyl hydrocarbons, and various types of esters including fatty acid esters, such as neopentyl glycol, trimethylolpropane, and pentaerythritol, and hindered esters. In the present invention, mineral oils are preferably used as the base oil in view of the life.

As the base oil, an oil having a Brookfield (BF) viscosity of 40,000 mPa.s or less at −40° C. and a kinematic viscosity of 2 $mm^2/s$ or more at 100° C. is preferably used. When BF viscosity at −40° C. is more than 40,000 mPa.s, the cold startability is occasionally insufficient. When the kinematic viscosity at 100° C. is less than 2 $mm^2/s$, a problem such as decrease in the strength of the oil film occasionally arises. In view of the above behavior, it is more preferable that BF viscosity is 20,000 to 40,000 mPa.s at −40° C. and the kinematic viscosity is 4 to 7 $mm^2/s$ at 100° C.

In the present invention, the mineral oil and the synthetic oil can be used in a single type or as a mixture of two or more types in a desired ratio.

In the present invention, it is preferred that the base oil comprises a viscosity index improver. Examples of the viscosity index improver comprised in the base oil include olefin (co)polymers such as ethylene-propylene copolymer, polymethacrylates, and polyisobutylene. Polymethacrylates are particularly preferable in view of the low temperature property. The number-average molecular weight of the viscosity index improver is preferably in the range of 10,000 to 1,000,000, more preferably in the range of 10,000 to 100,000, most preferably in the range of 10,000 to 50,000, in view of the shearing stability. The base oil comprising the viscosity index improver having a viscosity index (VI) of 130 or more, more preferably 160 or more, is particularly preferably used in view of the cold startability.

The above viscosity index improver is preferably comprised in the oil composition of the present invention in an amount of 3 to 20% by weight. When the viscosity index improver is used in this amount, advantageous results can be obtained with respect to the cold startability and the lubricating property at high temperatures.

The sulfonate as component (A) of the present invention is used mainly for obtaining an improved effect as the detergent dispersant and keeping a high friction coefficient. As the sulfonate, various conventional sulfonates can be used. In the present invention, sulfonates of alkaline earth metals, such as Ca, Mg, and Ba, are preferably used. Among these compounds, sulfonates of Ca and Mg are particularly preferably used in view of the increase in the friction coefficient in the high speed region. As the sulfonate, for example, alkaline earth metal salts of sulfonation products of aromatic compounds substituted with alkyl groups and compounds obtained by converting these sulfonation products into perbases with a hydroxide or an oxide of an alkaline earth metal and carbon dioxide are also preferably used. The sulfonates may have an alkyl group having 1 to 20 carbon atoms as the substituent.

As the above alkaline earth metal salt, perbasic compounds are preferably used in view of the increase in the friction coefficient. The total base number (TBN) of the alkaline earth metal salt is not particularly limited. TBN is preferably 100 to 500 mg KOH/g, more preferably 200 to 450 mg KOH/g.

It is preferred that the above sulfonate is contained in the composition of the present invention in an amount of 0.5 to 5% by weight. When the content is less than 0.5% by weight, the property to keep the high friction coefficient in the high speed region is occasionally insufficient. When the content is more than 5% by weight, the viscosity is increased occasionally leading to inferior cooling property. Moreover, the effect is saturated, and the cost is increased. In view of the above behavior, the content is more preferably 1 to 3% by weight.

In the present invention, a single type or a mixture of two or more types in a desired ratio of the above sulfonate can be used.

The ashless dispersant of component (B) of the present invention is used mainly for improving dispersion of sludges. Examples of the ashless dispersant include imide compounds, such as monoimides, bisimides, monoimide compounds containing boron, and bisimides containing boron. Among these compounds, imide compounds containing boron and bisimides not containing boron are preferably used. In the present invention, alkyl- or alkenylsuccinimide and alkyl- or alkenylsuccinimide containing boron are particularly preferably used.

The above ashless dispersant is preferably contained in the composition of the present invention in an amount of 1 to 6% by weight. When the content is less than 1% by weight, the property to disperse sludges is occasionally insufficient. When the content is more than 6% by weight, the wear resistance becomes occasionally inferior. In view of the above behavior, the content is more preferably 2 to 4% by weight.

In the present invention, a single type or a mixture of two or more types in a desired ratio of the above ashless dispersant can be used.

In the oil composition for CVT of the present invention, the acid amide of component (C) is used mainly for suppressing the friction coefficient after the oil composition is degraded by oxidation. The type of the used acid amide is not particularly limited, and any conventionally used acid amides can be used. The acid amide is preferably contained in the composition of the present invention in an amount of 0.1 to 1% by weight. When the content is less than 0.1% by weight, the effect to suppress the friction coefficient is occasionally insufficient. When the content is more than 1% by weight, the friction coefficient in the low speed region is occasionally decreased excessively. In view of the above behavior, the content is more preferably 0.2 to 0.8% by weight.

The organomolybdenum compound of component (D) is used mainly for suppressing increase in the friction coefficient ($\mu_s$) in the present invention. As the organomolybdenum compound, molybdenum dithiophosphate (MoDTP) and molybdenum dithiocarbamate (MoDTC) are particularly preferably used. The organomolybdenum compound is preferably contained in the composition of the present invention in an amount of 0.01 to 1% by weight (50 to 500 ppm in terms of the content of molybdenum). When the content is less than 0.01% by weight, the effect to suppress the friction coefficient is occasionally insufficient. When the content is more than 1% by weight, the friction coefficient in the low speed region is occasionally decreased excessively. In view of the above behavior, the content is more preferably 0.03 to 0.6% by weight.

In the present invention, an amine antioxidant is used as component (E) mainly for the purpose of effectively suppressing the change of the friction property of CVT with time.

The type of the amine antioxidant used as component (E) is not particularly limited, and various types of conventional amine antioxidant can be used. Examples of the amine antioxidant include diphenylamine derivatives represented by the following general formula (I):

(I)

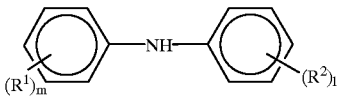

wherein $R^1$ and $R^2$ represent each independently an alkyl group having 1 to 20 carbon atoms or an alkenyl group having 1 to 20 carbon atoms, m and 1 represent each independently an integer of 0 to 4, and a plurality of $R^1$ and $R^2$ may be the same with each other or different from each other. Examples of the diphenylaimine derivative represented by general formula (I) include diphenylamine, dioctyldiphenylamine, dinonyldiphenylamine, dioleyldiphenylamine, and p-butyl-p'-octyldiphenylamine.

Examples of the amine antioxidant also include phenyl-α-naphthylamine derivatives represented by the following general formula (II):

(II)

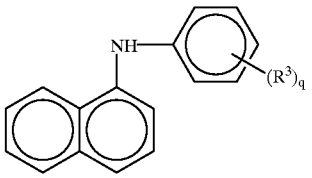

wherein $R^3$ represents an alkyl group having 1 to 20 carbon atoms or an alkenyl group having 1 to 20 carbon atoms, q represents an integer of 0 to 5, and a plurality of $R^3$ may be the same with each other or different from each other. Examples of the phenyl-α-naphthylamine represented by general formula (II) include phenyl-α-naphthylamine, octylphenyl-α-naphthylamine, and oleylphenyl-α-naphthylamine.

The content of the amine antioxidant of component (E) is generally 0.1 to 1% by weight of the whole amount of the composition of the present invention. When the content is less than 0.1% by weight, the effect to prevent oxidation is insufficient, and moreover, the effect to suppress the change of the friction property with time is occasionally insufficient. When the content is more than 1% by weight, additional effect to suppress the change with time cannot be expected. In view of the above behavior, the content is more preferably 0.2 to 0.8% by weight.

A single type or a combination of two or more types of the amine antioxidant can be used.

The oil composition for CVT of the present invention is prepared by mixing above components (A) to (E) as the essential components. The oil composition may additionally comprise at least one type selected from the group consisting of (F) a derivative of a fatty acid, (G) a partially esterified compound, and (H) an antioxidant containing sulfur, where desired.

As the derivative of a fatty acid of component (F), various types of conventional derivatives of fatty acids can be used. In the present invention, derivatives of sarcosine, for example, N-acylsarcosines such as oleylsarcosine and stearylsarcosine, are preferably used in view of the effect of suppressing the friction coefficient in the low speed region. As the partially esterified compound of component (G), for example, partial esterification products of glycerol and partial esterification products of alkenylsuccinimides can be used.

As the antioxidant containing sulfur of component (H), various types of conventional antioxidants containing sulfur can be used without particular restriction on the type. Examples of the antioxidant containing sulfur include dilauryl thiodipropionate, It is preferred that the derivative of a fatty acid of component (F), the partially esterified compound of component (G), and the antioxidant containing sulfur of component (H) are each used in an amount of 0.1 to 1% by weight of the composition of the present invention. When the contents of these components are within the above range, retention of the initial characteristic of the friction coefficient and increase in the life under oxidation are enabled, and still more advantageous results can be obtained.

In the oil composition for CVT of the present invention, a metal deactivator, such as copper deactivator, for preventing corrosion of nonferrous metals and defoaming agents can suitably be comprised in addition to the above components where necessary. The type of such additives is not particularly limited. Examples of the metal deactivator include thiadiazol compounds. Examples of the defoaming agent include silicone compounds. These additives are generally comprised each in an amount of 0.15% by weight or less of the composition of the present invention.

In the present invention, the oil composition for CVT can be obtained by suitably mixing the above components. By using the thus obtained oil composition for CVT, the scratching phenomenon can be prevented while the force transmitted by CVT of a belt type can be kept large. The oil composition for CVT can exhibit the above effects of the present invention still more excellently when the prepared composition shows the properties that the minimum friction coefficient between steel parts, for example between a belt and a top, is 0.1 or more at 100° C. and that the $\mu$-V characteristic shows a positive gradient, i.e., the friction coefficient increase with the increase in the slipping speed. More specifically, the oil composition can exhibit the above effects still more excellently when the prepared composition shows the properties that the minimum friction coefficient at 100° C. is 0.1 or more and that the ratio ($\mu_s/\mu_d$) is smaller than 1. In other words, the force transmitted by CVT of a belt type can be increased by adjusting the above minimum friction coefficient to 0.1 or more, and the scratching phenomenon can be prevented by adjusting the gradient of the $\mu$-V characteristic to a positive value.

Moreover, the oil composition for CVT of the present invention can maintain the above characteristics not only in the fresh condition but also in the condition after the oil composition is used by driving the automobile for a specified time. In other words, the oil composition has the above $\mu$ value in the range of 0.1 or more, the above ratio ($\mu_s/\mu_d$) in the range smaller than 1, and a positive gradient in the $\mu$-V characteristic even after the oil composition is used by driving the automobile for a specified time.

In the present invention, the value of the minimum friction coefficient ($\mu$) is measured by a rotating friction tester which gives the friction coefficient between two surfaces by the mechanism shown in FIG. 1. Values of $\mu$ obtained by the measurement conducted, for example, under the condition of an oil temperature of 100° C., a rotational speed of 10 rpm, and a load of 12 MPa are advantageously used. Values of the ratio ($\mu_s/\mu_d$) obtained by the measurement under the condition of an oil temperature of 100° C., a rotational speed of 10 rpm/40 rpm, and a load of 2 MPa are advantageously used. The $\mu$-V characteristics obtained by the measurement using the above rotating friction tester under the condition of an oil temperature of 100° C., a rotational speed of 10 to 40 rpm, and a load of 2 MPa are advantageously used.

To summarize the advantages of the present invention, the oil composition for CVT of the present invention can prevent the scratching phenomenon while the power transmitted by CVT of a belt type used for automatic transmissions of automobiles is kept large. Because the gradient in the $\mu$-V characteristic is kept positive for a long time by using the oil composition for CVT of the present invention, the above effects can be exhibited even after the oil composition is used by the driving for a long time.

The present invention is described specifically with reference to examples in the following.

EXAMPLES 1 TO 3 AND COMPARATIVE EXAMPLES 1 TO 5

Oil compositions for CVT were prepared in accordance with the formulations (expressed in terms of % by weight) shown in Table 1. The obtained fresh oil compositions and oil compositions treated for degradation with oxidation under the condition of a temperature of 150° C. for a time of 48 hours were evaluated with respect to the $\mu_s$ value and the ratio ($\mu_s/\mu_d$) by the measurement using a rotating friction tester (a product of Tosoku Seimitsu Kogyo Co., Ltd.) under the following condition. The friction tester gives the friction coefficient between two surfaces in accordance with the mechanism shown in FIG. 1. The results are shown in Table 1.

The $\mu_s$ value oil temperature: 100° C.

rotational speed: 10 rpm load: 12 MPa

The ratio ($\mu_s/\mu_d$)

oil temperature: 100° C.

rotational speed: 10 rpm and 40 rpm load: 2 MPa

TABLE 1

| | Example | | |
|---|---|---|---|
| | 1 | 2 | 3 |
| formulation, % by weight | | | |
| base oil*1 | the rest | the rest | the rest |
| polymethacrylate*2 | 10.0 | 10.0 | 10.0 |
| detergent dispersant | | | |
| imide*3 | 2.0 | 2.0 | 2.0 |
| imide containing boron*4 | 1.0 | 1.0 | 1.0 |
| Ca sulfonate*5 | 1.0 | 1.0 | 1.0 |
| Mg sulfonate*6 | 1.0 | 1.0 | 1.0 |
| friction modifier | | | |
| acid amide*7 | 0.5 | 0.5 | 0.5 |
| derivative of sarcosine*8 | 0.1 | 0.2 | 0.2 |
| MoDTC | — | 0.15 | 0.2 |
| MoDTP | 0.25 | — | — |
| antioxidant | | | |
| amine antioxidant*9 | 0.5 | 0.5 | 0.5 |
| antioxidant containing sulfur*10 | 0.5 | 0.5 | 0.5 |
| defoaming agent*11 | 0.1 | 0.1 | 0.1 |
| metal deactivator*12 | 0.03 | 0.03 | 0.03 |
| fresh oil | | | |
| ratio of $\mu_s/\mu_d$ | 0.92 | 0.88 | 0.85 |
| $\mu_s$ | 0.114 | 0.108 | 0.104 |
| oil after degradation by oxidation | | | |
| ratio of $\mu_s/\mu_d$ | 0.95 | 0.98 | 0.95 |
| $\mu_s$ | 0.118 | 0.112 | 0.114 |

| | Comparative Example | | | | |
|---|---|---|---|---|---|
| | 1 | 2 | 3 | 4 | 5 |
| formulation, % by weight | | | | | |
| base oil*1 | the rest | the rest | the rest | the rest | the rest |
| polymethacrylate*2 | 10.0 | 10.0 | 10.0 | 10.0 | 10.0 |
| detergent dispersant | | | | | |
| imide*3 | 2.0 | 2.0 | 2.0 | 2.0 | 2.0 |
| imide containing boron*4 | 1.0 | 1.0 | 1.0 | 1.0 | 1.0 |
| Ca sulfonate*5 | 1.0 | 1.0 | 1.0 | 1.0 | — |
| Mg sulfonate*6 | 1.0 | — | 1.0 | 1.0 | — |
| friction modifier | | | | | |
| acid amide*7 | — | 0.5 | — | 0.5 | 0.5 |
| derivative of sarcosine*8 | 0.1 | 0.2 | 0.2 | 0.2 | 0.2 |
| MoDTC | 0.3 | — | 0.2 | 0.2 | — |
| MoDTP | — | — | — | — | 0.65 |
| antioxidant | | | | | |
| amine antioxidant*9 | 0.5 | 0.5 | 0.5 | — | 0.5 |
| antioxidant containing sulfur*10 | 0.5 | 0.5 | 0.5 | 0.5 | 0.5 |
| defoaming agent*11 | 0.1 | 0.1 | 0.1 | 0.1 | 0.1 |
| metal deactivator*12 | 0.03 | 0.03 | 0.03 | 0.03 | 0.03 |
| fresh oil | | | | | |
| ratio of $\mu_s/\mu_d$ | 0.87 | 1.12 | 0.92 | 0.88 | 0.80 |
| $\mu_s$ | 0.080 | 0.118 | 0.100 | 0.108 | 0.083 |
| oil after degradation by oxidation | | | | | |
| ratio of $\mu_s/\mu_d$ | 1.05 | 1.12 | 1.06 | 1.20 | 1.25 |
| $\mu_s$ | 0.127 | 0.130 | 0.122 | 0.128 | 0.134 |

*1base oil; a paraffinic mineral oil (kinematic viscosity at 100° C., 5 $mm^2/s$)
*2a polymethacrylate; molecular weight, 50,000
*3an imide; bispolybutenylsuccinimide
*4an imide containing boron; polybutenylsuccinimide containing boron
*5a Ca sulfonate; TBN = 400 mg KOH/g
*6a Mg sulfonate; TBN = 400 mg KOH/g
*7an acid amide; an amide obtained from a fatty acid and a polyalkylenepolyamine
*8a derivative of sarcosine; oleyl sarcosine
*9an amine antioxidant; an alkylated diphenylamine
*10an antioxidant containing sulfur; dilauryl thiodipropionate
*11a defoaming agent; dimethylpolysiloxane
*12metal deactivator; a thiadiazol compound The oil compositions obtained in Example 2 and Comparative Example 2 were subjected to the field test using an automobile, and the results were evaluated with respect to the scratching phenomenon in accordance with the following classification:

○: no abnormal sound generated by the scratching phenomenon

Δ: some abnormal sound generated by the scratching phenomenon x: loud sound generated by the scratching phenomenon The field test using an automobile By using a gasoline automobile equipped with CVT of a belt type, the generation of abnormal sound was examined at a speed of 20 km/hour or less at the oil temperatures shown in Table 2. The results are shown in Table 2.

TABLE 2

| oil temperature (° C.) | 60 | 80 | 100 | 120 |
|---|---|---|---|---|
| Example 2 | ○ | ○ | ○ | ○ |
| Comparative Example 2 | Δ | x | x | Δ |

What is claimed is:

1. An oil composition consisting essentially of a base oil, (A) 0.5–5 wt. % of a sulfonate, (B) 1–4 wt. % of an ashless dispersant, (C) 0.1–1 wt. % of an acid amide, (D) 0.01–1 wt. % of an organomolybdenum compound, and (E) 0.1–1 wt. % of an amine antioxidant.

2. An oil composition according to claim 1 wherein the base oil contains a viscosity index improver.

3. An oil composition according to claim 1 wherein the ashless dispersant of component (B) is an imide compound.

4. An oil composition according to claim 3 wherein the organomolybdenum compound of component (D) is molybdenum dithiophosphate or molybdenum dithiocarbamate.

5. An oil composition according to claim 4 wherein the oil composition contains at least one member selected from the group consisting of (F) a derivative of a fatty acid, (G) a partially esterified compound, and (H) an antioxidant containing sulfur.

6. An oil composition according to claim 1 wherein the organomolybdenum compound of component (D) is molybdenum dithiophosphate or molybdenum dithiocarbamate.

7. An oil composition according to claim 6 wherein the oil composition contains at least one member selected from the group consisting of (F) a derivative of a fatty acid, (G) a partially esterified compound, and (H) an antioxidant containing sulfur.

8. An oil composition according to claim 1 wherein the oil composition contains at least one type selected from the group consisting of (F) a derivative of a fatty acid, (G) a partially esterified compound, and (H) an antioxidant containing sulfur.

9. An oil composition according to claim 1 wherein the oil composition has a minimum friction coefficient ($\mu$) of 0.1 or larger at 100° C. and a ratio ($\mu_s/\mu_d$) of a friction coefficient $\mu_s$ to a friction coefficient $\mu_d$ smaller than 1 wherein $\mu_s$ represents a friction coefficient immediately before slipping speed is reduced to zero, and Ad represents a friction coefficient at a slipping speed of V.

10. An oil composition prepared by mixing together ingredients consists essentially of:

A) 0.5–5 weight percent of a sulfonate;

B) 1–4 weight percent of an ashless dispersant;

C) 0.1–1 weight percent of an acid amide;

D) 0.01–1 weight percent of an organomolybdenum compound;

E) 0.1–1 weight percent of an amine antioxidant; and

F) a base oil.

11. The oil composition according to claim 10, wherein said base oil has a Brookfield viscosity of 20,000 to 40,000 mPa.s at −40° C. and a kinematic viscosity of 4–7 $mm^2/s$ at 100° C.

12. The composition as claimed in claim 10, wherein 0.03 to 0.6 percent by weight of said organomolybdenum compound is mixed with said sulfonate, ashless dispersant, acid amide, amine antioxidant and base oil.

13. The composition according to claim 1, wherein said base oil has a Brookfield viscosity of 20,000 to 40,000 mPa.s at −40° and a kinematic viscosity of 4–7 $mm^2/s$ at 100° C.

14. The composition of claim 1, comprising 0.03–0.6 weight percent organomolybdenum compound.

15. The composition of claim 1, wherein said oil provides a ratio $\mu_s/\mu_d$ which is less than 1 after degradation by oxidation at 150° C. for 48 hours.

16. The composition of claim 10, wherein said oil provides a ratio $\mu_s/\mu_d$ which is less than 1 after degradation by oxidation at 150° C. for 48 hours.

17. The oil composition as claimed in claim 1 consisting essentially of a base oil, 1 to 3% by weight of component A, 2 to 4% of component B, 0.2 to 0.8% by weight of component C, 0.03–0.6 by weight of component D, and 0.2 to 0.8 by weight of component E.

18. The composition as claimed in claim 1, having 2 to 4% by weight of component B.

19. The oil composition as claimed in claim 10, prepared by mixing together at least the following ingredients: 1 to 3% by weight of component A, 2 to 4% by weight of component B, 0.2 to 0.8% by weight of component C, 0.03 to 0.6% by weight of component D, 0.2 to 0.8% by weight of component E, and component F.

20. The oil composition as claimed in claim 10, prepared by mixing together components A, 2 to 4% by weight of component B, component C, component D, component E, and component F.

* * * * *